US006582276B1

(12) United States Patent
Bao

(10) Patent No.: US 6,582,276 B1
(45) Date of Patent: Jun. 24, 2003

(54) TOY WASHING MACHINE

(75) Inventor: Wei Gang Bao, Dongguan (CN)

(73) Assignee: Golden Bright Manufacturer Limited, Kowloon (HK)

( * ) Notice: Subject to any disclaimer, the term of this patent is extended or adjusted under 35 U.S.C. 154(b) by 0 days.

(21) Appl. No.: 10/055,756

(22) Filed: Jan. 22, 2002

(51) Int. Cl.[7] ..... A63H 33/30

(52) U.S. Cl. ..... 446/479; 446/267; 446/236; 68/12.26

(58) Field of Search ..... 446/484, 479, 446/424, 267, 236, 176; 68/12.26, 12.21

(56) References Cited

U.S. PATENT DOCUMENTS 2,615,280 A * 10/1952 Thelin
3,152,461 A * 10/1964 Glover, Jr.
3,187,459 A * 6/1965 Glass et al.
3,811,300 A * 5/1974 Barton et al. ..... 68/12 R
4,338,741 A * 7/1982 Tsui et al.
4,341,034 A * 7/1982 Tsui et al.
5,215,491 A * 6/1993 Willet et al. ..... 446/176

* cited by examiner

*Primary Examiner*—Derris H. Banks
*Assistant Examiner*—Jamila O Williams
(74) *Attorney, Agent, or Firm*—Morrison & Foerster LLP

(57) ABSTRACT

A toy washing machine has a safety function to prevent the release of water and the like. The safety function locks the door of the toy washing machine when the machine is filled with water. As water is poured into the machine, it flows to a container positioned below an internal drum cabin. The container has a float that rises as the container fills with water. The rising of the float activates a lever device that is connected to a pin. The pin locks the door and prevents the door from opening when water is within the machine. The door of the machine has a seal made of heterotypic silicon rubber that prevents leakage.

18 Claims, 7 Drawing Sheets

TOY WASHING MACHINE

BACKGROUND OF THE INVENTION

1. Field of the Invention

The present invention relates to a toy washing machine with a safety function to prevent the release of water and the like.

2. Description of Related Art

For drum-type toy washing machines, there are products on sale that can provide some movements and sound but cannot be played with water. A few other products can be filled with water but their sealing effect is poor and leakage occurs easily. In addition, there is no safety device at the door latch. When playing with such toys, a pull at the door latch will cause all the water to come out, causing inconvenience to both the child and parents.

The present invention of the toy washing machine overcomes the aforesaid defects. The present invention not only can utilize water, but also provides an air-tight seal and automatically locks the water inside. It cannot be opened with the strength of the fingers of a child, thereby preventing the accidental outflow of water and allowing the child to enjoy playing in a safe and reliable manner.

SUMMARY OF THE INVENTION

The present invention comprises a complete system of water sealing, water inflow, safety, water playing and draining. In the preferred embodiment, it includes a movable door with a heterotypic silicon rubber seal, metal hinges on both sides of the door and a safety lock that holds the door tight against the outer part of the drum cabin that holds water and is sealed by the rubber seal. On the upper part of the preferred embodiment, there is a drawer for water inflow which is connected by a water hose at the lower part of the water-storing drum cabin which in turn is connected to the floating pontoon cabinet. When water is poured from the drawer, it flows through the water hose into the floating pontoon cabinet, causing the floating pontoon to rise and activating a lever device by means of a small rubber tube on the upper part. The lever device then presses down a tiny stainless spring where a stainless steel pin moves downward due to its weight and locks the spring inside the safety door lock. Due to the effect of the lock spring, the door latch cannot be opened by hand from outside, thereby effecting the safety function that the door cannot be opened when there is water inside. As water increases, it begins to flow into the drum cabin after it has filled the floating pontoon cabinet. The door remains sealed as long as there is water in the drum cabin (from its lowest level to as high as two-thirds of the drum cabin as specified by product specifications).

On the upper part of the drum cabin, there is a ventilation tube to ensure that the air pressure inside the drum cabin is the same as that of the atmosphere for the ease of inflow and draining of water.

Upon completion of the aforesaid, the switch on the operation panel can then be operated to connect the current from the battery cabinet. By pressing down the start button, the electronic panel will operate the gear box in accordance with a pre-determined process to drive the drum to rotate clockwise and then counter-clockwise and giving out at the same time the simulated splashing sound of water. The lamp on the operation panel also begins flashing rhythmically.

After the aforesaid process, the drum stops rotating while the flashing of the lamp continues amidst the sound of a siren to indicate to the child that the laundry process has been completed and that the door can be opened to drain the water. As water has not yet completely drained off, the safety function of the door lock is still in effect and the door cannot be opened by hand.

The drain hose at the back of the preferred embodiment can be taken out and placed on a level surface. By opening the plug of the draining hose, the water in the drum cabin comes out of the bottom part of the floating pontoon cabinet which is at its lowest level. As long as there is water in the drum cabin, there is water in the floating pontoon cabinet, because it is positioned at the lowest part of the drum cabin. As long as there is water in the floating pontoon cabinet, the floating pontoon remains at its highest position, activating thereby the lever device that presses the stainless steel spring and causes the stainless steel pin to firmly lock the door to maintain the safety function of the door lock. Only after the water in the drum cabin has been completely drained off will the floating pontoon go down gradually with the decrease of the water level. As the floating pontoon goes down, there is no longer any pressure on the lever device, and the stainless steel spring pushes the head of the stainless steel pin upward and withdraws it from the lock spring of the door lock. At this moment, the safety door lock is in its open position and can be easily opened by pulling the handle of the door latch. At this point, there is no longer any water in the drum cabin and safety is ensured. Thereafter, by closing the plug on the drain hose and hanging it back onto the back of the washing machine, the door can be closed and the processes of water playing can be repeated.

A more complete understanding of the present invention will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1A:
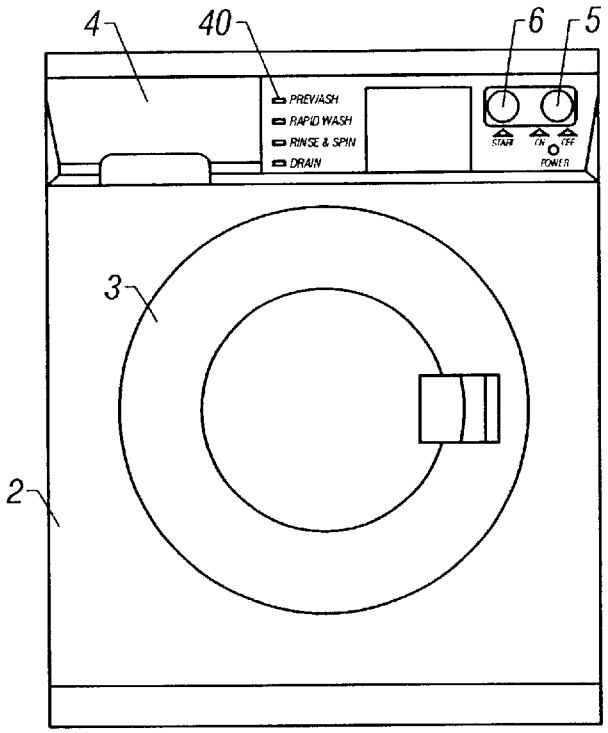
FIG. 1A shows the front view of the preferred embodiment.

A preferred embodiment of the present invention will be described in detail by referring to the drawings.

Figure 1B:
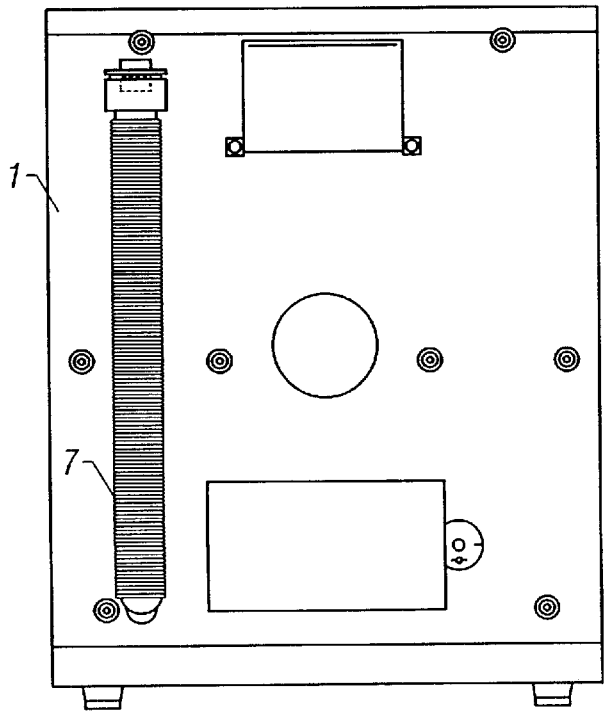
FIG. 1B shows the back view of the preferred embodiment.

It can be seen from FIG. 1A and FIG. 1B that the preferred embodiment comprises the machine casing 1 and the front panel 2 which constitute the overall external form. In the middle of the front panel 2 there is a round door 3 to seal off the water from the internal drum cabin. On the upper part, there is a drawer 4 for the inflow of water. The button 5 on the upper part of the panel is a switch, and the other button 6 is a power control button of the internal electronic panel for activating the controlling processes. The long hose 7 at the back is a draining hose.

Figure 2:
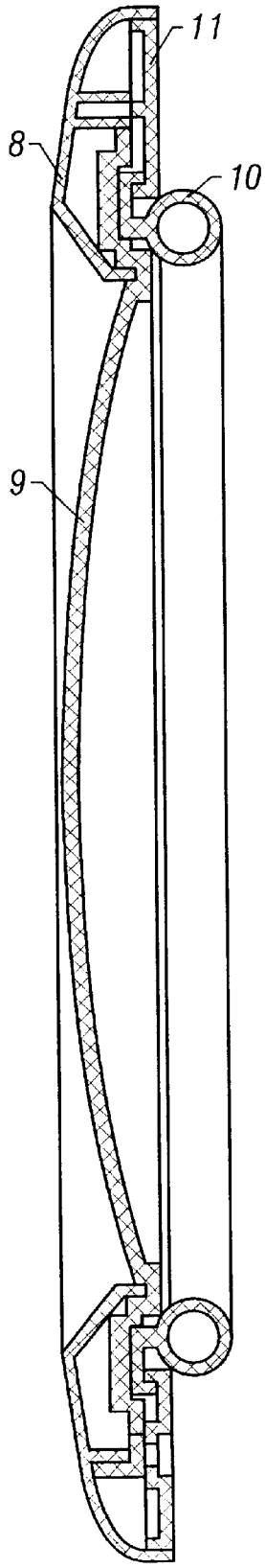
FIG. 2 shows a cross-sectional view of the door of the preferred embodiment.

As illustrated in FIG. 2, the structure of the door comprises an outer casing 8, a glass pane 9, a heterotypic silicon rubber seal 10 and an internal door cover 11. The two external hollow casings 8 of the round door, the internal door cover 11 and the glass pane 9 are firmly and solidly held together by means of screws to form a firm structure, ensuring the strength and the seal of the door against distortion and leakage.

Figure 3:
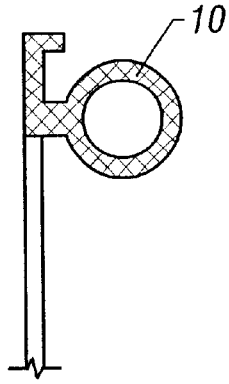
FIG. 3 shows a cross-sectional view of the seal of the preferred embodiment.

It can be seen from FIG. 2 and FIG. 3 that the shape of the heterotypic silicon rubber seal 10 enables the heterotypic silicon rubber seal 10 to be pressed tightly against the notch of the glass pane 9 and the flange of the internal cover 11 when joined together. The purpose is two fold: (i) to accurately and firmly position the heterotypic silicon rubber seal 10 and prevent it from falling off and; (ii) to press the glass pane 9 tightly against the heterotypic silicon rubber seal 10 so as to achieve an air-tight sealing effect. The circular hollow portion in the middle of the heterotypic silicon rubber seal 10 provides better elasticity when it is evenly and firmly pressed against the internal cover 11 of the door and the front panel 2 to seal off the water. The structural shape and the properties of the material used (high elasticity, resistance to high and low temperatures and anti-aging) allows an air-tight sealing effect to be achieved.

Figure 4A:
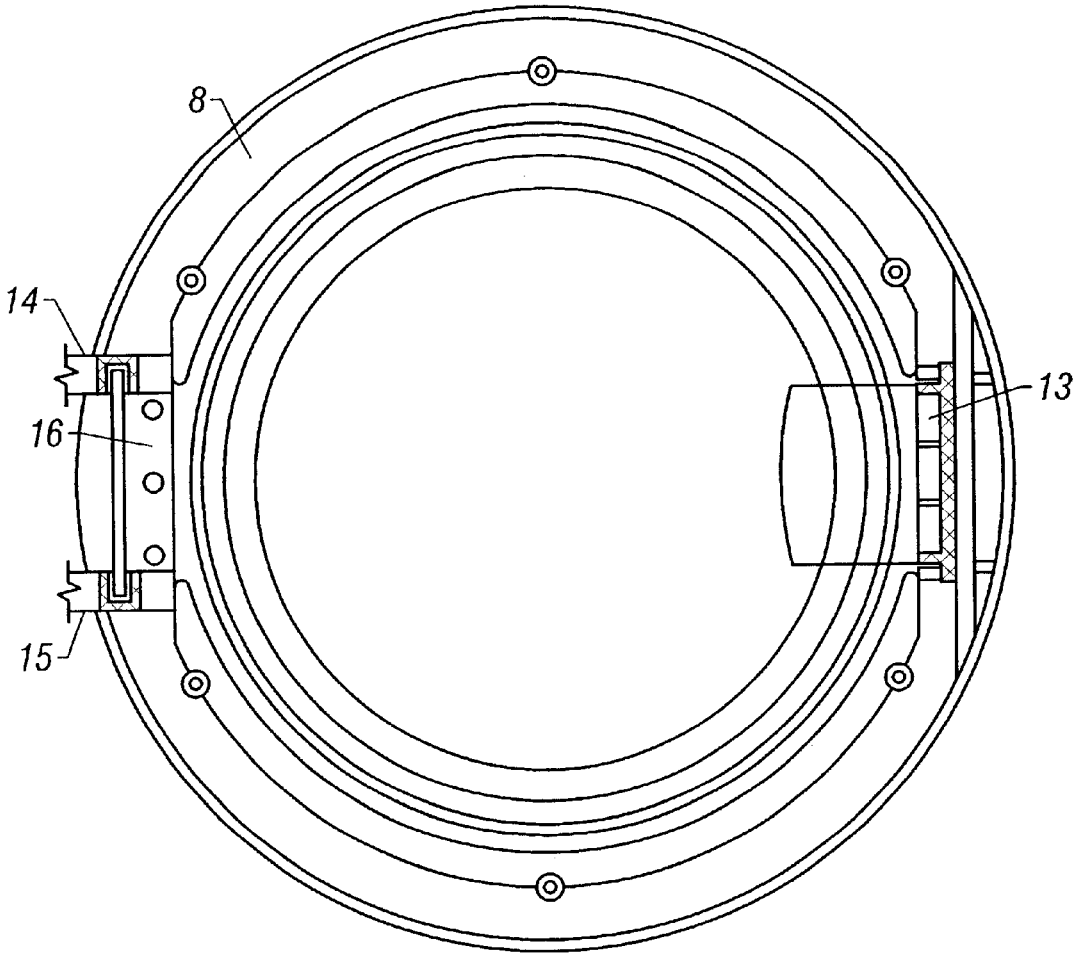
FIG. 4A shows a front view of the door of the preferred embodiment.
Figure 4B:
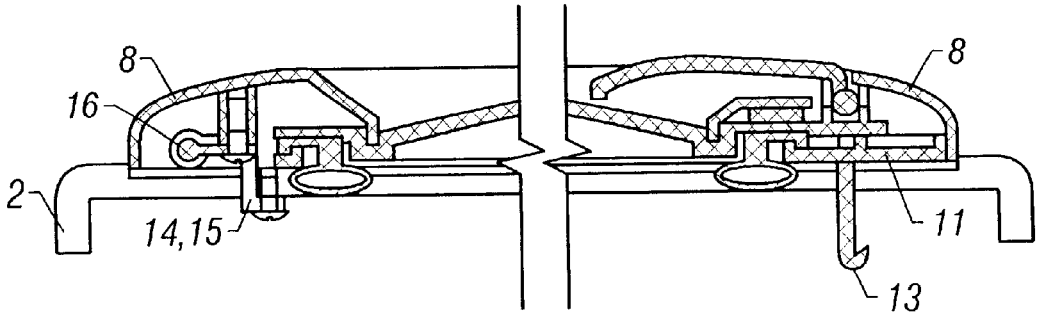
FIG. 4B shows a cross-sectional view of the door of the preferred embodiment.
Figure 5:
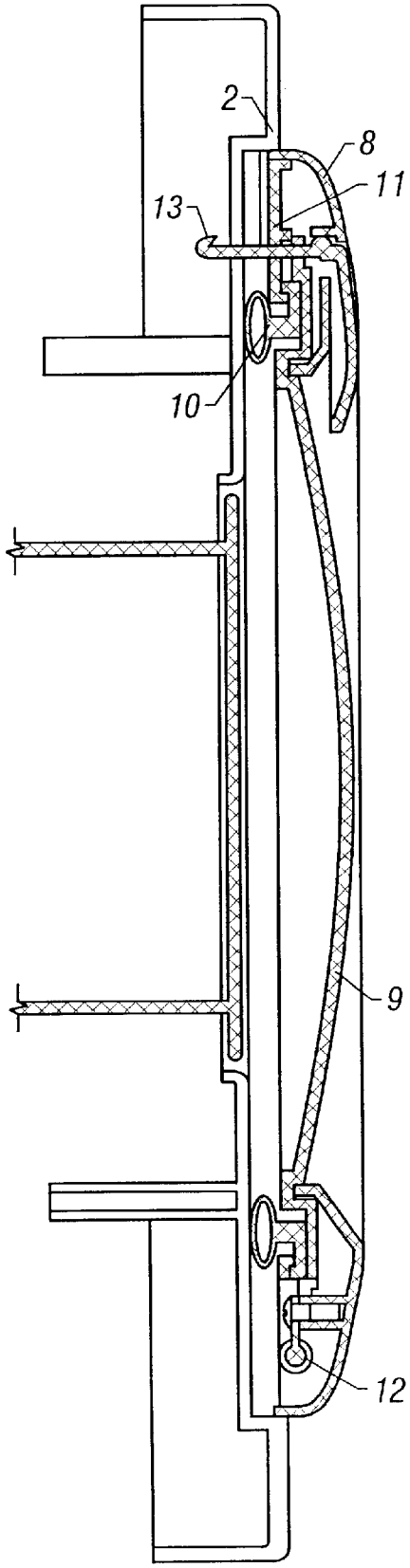
FIG. 5 shows a cross-sectional view of the door and front panel of the preferred embodiment.

It can be seen from FIG. 1A and FIG. 5 that the door is a movable unit independent of the front panel 2. The accurate positioning of the door and its connection to the front panel are achieved by means of the hinges 12 and door latch 13. Therefore the design of the hinges 12 must be strong and precise. From FIG. 4A and FIG. 4B, it can be seen that hinge 14 and hinge 15 are fixed onto the front panel 2, whereas hinge 16 is fixed onto the outer casing 8, and the three hinges are joined by a round axle of the two ends of hinge 16, forming a complete system of pivoted rotating hinges. As the hinges are made of metal, they meet the requirements of design in terms of strength and precision.

FIG. 4A and FIG. 4B also show the door latch 13 which is joined to the external door casing 8 and internal door cover 11 by a round axle from one end to the other to ensure precise positioning, achieving thereby the movability of the door latch with the least components and simplicity of structure.

Figure 6A:
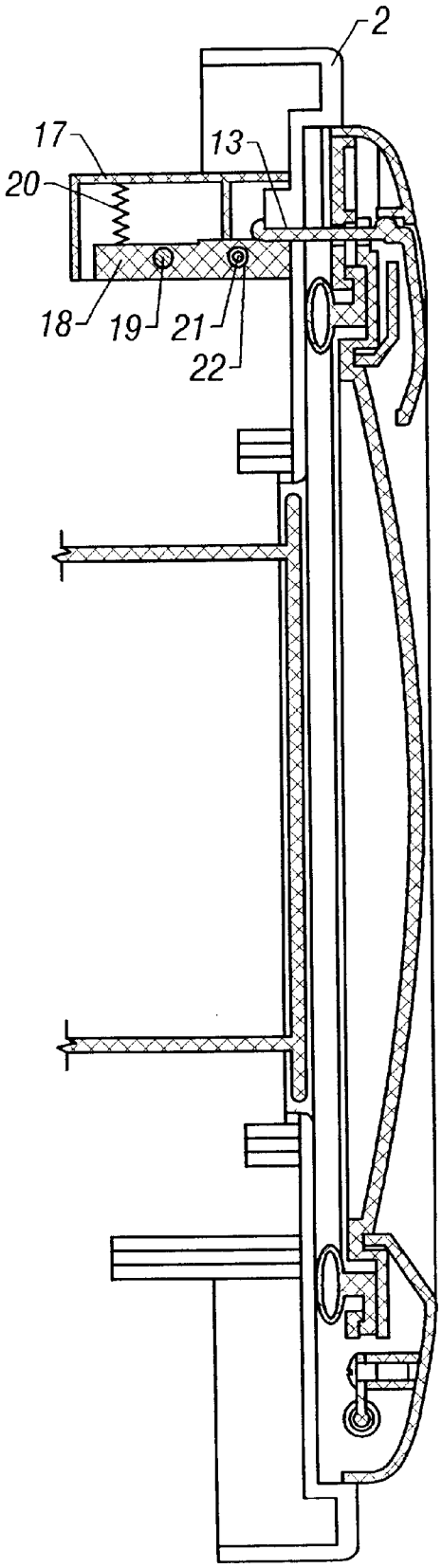
FIG. 6A shows a cross-sectional view of the door, the front panel and the door lock device of the preferred embodiment.
Figure 6B:
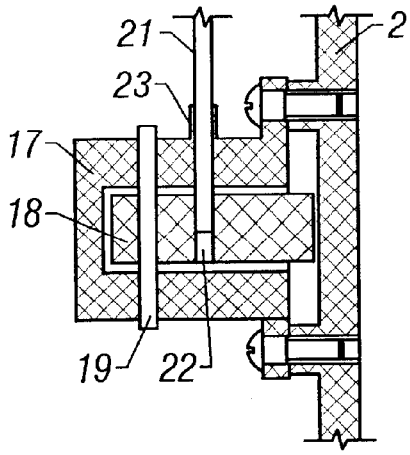
FIG. 6B shows a cross-sectional view of the door lock device of the preferred embodiment.

It can be seen from FIG. 6A and FIG. 6B that the door lock device comprises a door lock casing 17, a door lock spring 18, a positioning metal axle 19, a pressure spring 20 and a stainless steel pin 21. The door lock spring 18 is fixed onto the door lock casing 17 by means of the metal axle 19, forming thereby an internal lever device. One end of the door lock spring 18 is connected to the door lock casing 17 by means of the pressure spring 20. The other end of the door lock spring 18 presses against that portion of the door latch 13 inside the door lock, pressing the door latch hard against the step of the front panel 2 due to the leverage activated by the force of the pressure spring 20, ensuring thereby the precise positioning of the door latch.

Simultaneously, the circular hole 22 on the door lock spring 18 coincides with the circular hole on the door lock casing 17 where the stainless steel pin 21, guided by a hollow plastic tube 23 on the upper part of the door lock casing 17 where the concentric holes are, smoothly passes through the concentric holes to fix the position of the door lock spring 18. As the position of the door lock spring 18 is fixed, the door latch 13, being unable to separate from the step of the front panel 2, is locked inside the door lock, effecting thereby the safety function of the door look. Conversely, when the stainless steel pin 21 rises and entirely leaves the circular hole on the door lock spring 18, the door latch 13 presses against one end of the door lock spring 18 due to the external pull. When this external pull is greater than the force of the pressure spring 20 at the other end, the door latch 13 leaves the step of the front panel 2 and withdraws smoothly from the door lock and the door opens. Thus, when the stainless steel pin 21 descends into the circular hole 22 on the door lock spring 18, the safety function of the door lock is activated. Conversely, when the stainless steel pin 21 ascends and leaves the round hole 22 on the door lock spring 18, the safety device is deactivated and the door latch can be pulled out.

Figure 7:
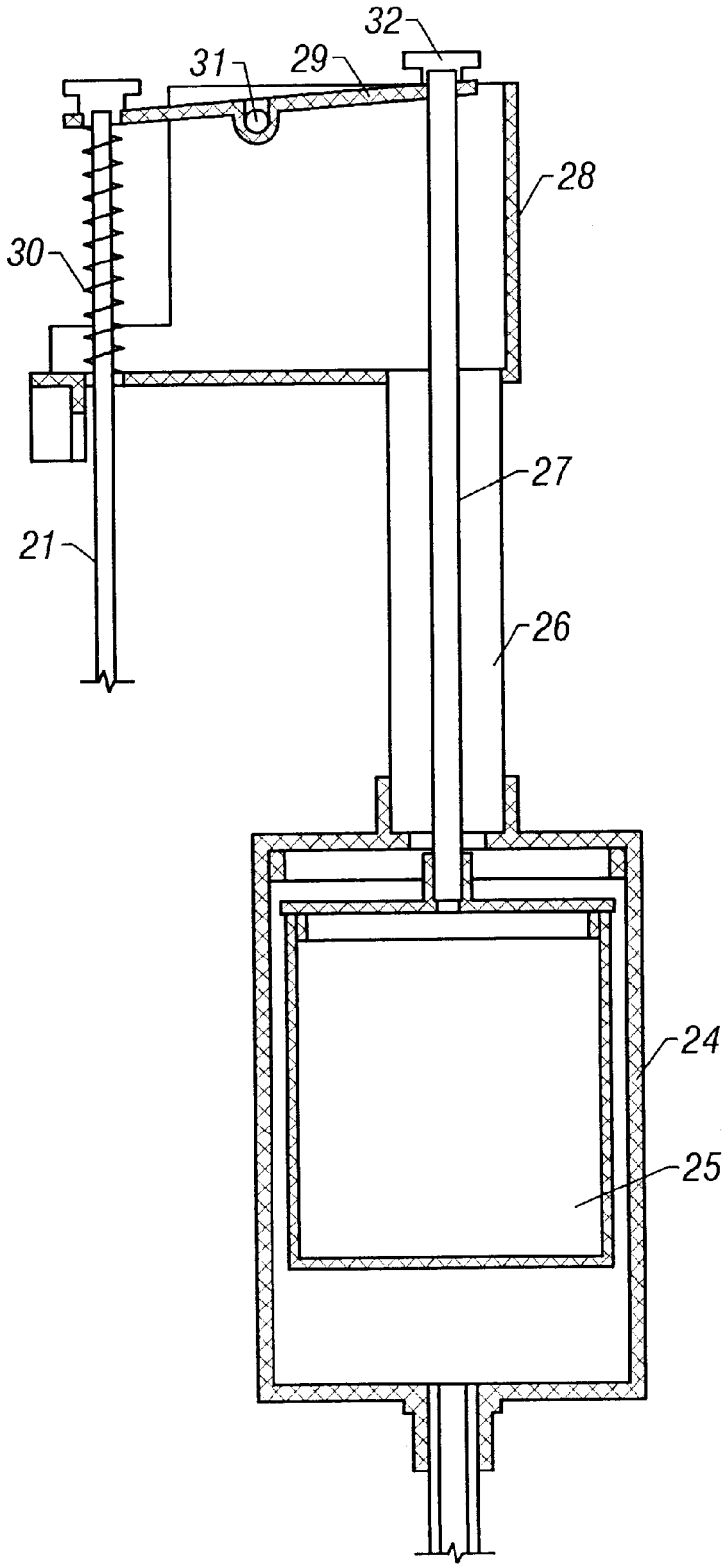
FIG. 7 shows a cross-sectional view of the floating device of the preferred embodiment.

It can be seen from FIG. 7 that the floating pontoon device comprises a floating pontoon cabinet 24, a floating pontoon 25, a guiding tube 26 on the upper part of the floating pontoon cabinet 24 and a rubber tube 27 on the upper part of the floating pontoon 25. Water flows in through the bottom part of the floating pontoon cabinet 24. With the rise of water level in the floating pontoon cabinet 24, the floating pontoon 25 rises to the top, and so does the rubber tube 27 connected to it. Conversely, the floating tube 27 also descends with the floating pontoon 25 on its down movement. The function of the guiding tube 26 is to prevent water from flowing out and allows ventilation of the floating pontoon cabinet 24 to facilitate the inflow and draining of water.

On the upper part of the floating pontoon device there is a lever device comprising an external casing 28, a lever 29, a spring 30 and a stainless steel pin 21. In the middle of the lever 29 there is a nail 31 that fixes the lever onto the external casing 28 which is also the supporting point of the lever. One end of the lever 29 is loosely fixed onto the head of the rubber tube 27 by a rubber nail 32. The other end of the lever 29 is loosely fixed by the stainless steel pin 21 and presses against the spring 30. When there is no water in the floating pontoon cabinet 24, the floating pontoon 25 and the rubber tube 27 descends due to gravitation while the other end of the lever ascends due to the force of the spring 30, thereby moving the stainless steel pin 21 upward to its highest position. When there is water in the floating pontoon cabinet 24, the floating pontoon 25 and the rubber tube 27 ascend. It has been predetermined by the device that the force of the spring 30 is weaker than the floatage of the floating pontoon 25. As a result, when the rubber tube 27 rises, it causes one end of the lever 29 to rise and the other end to press against the spring 30 and descends by means of the leverage produced by the fulcrum. The stainless steel pin 21 also descends due to gravitation. This is the working principle of the floating pontoon and the lever devices whereby the stainless steel pin 21 descends with the inflow of water into the floating pontoon cabinet 24, and ascends when the water in the floating pontoon cabinet 24 drains off.

Figure 8:
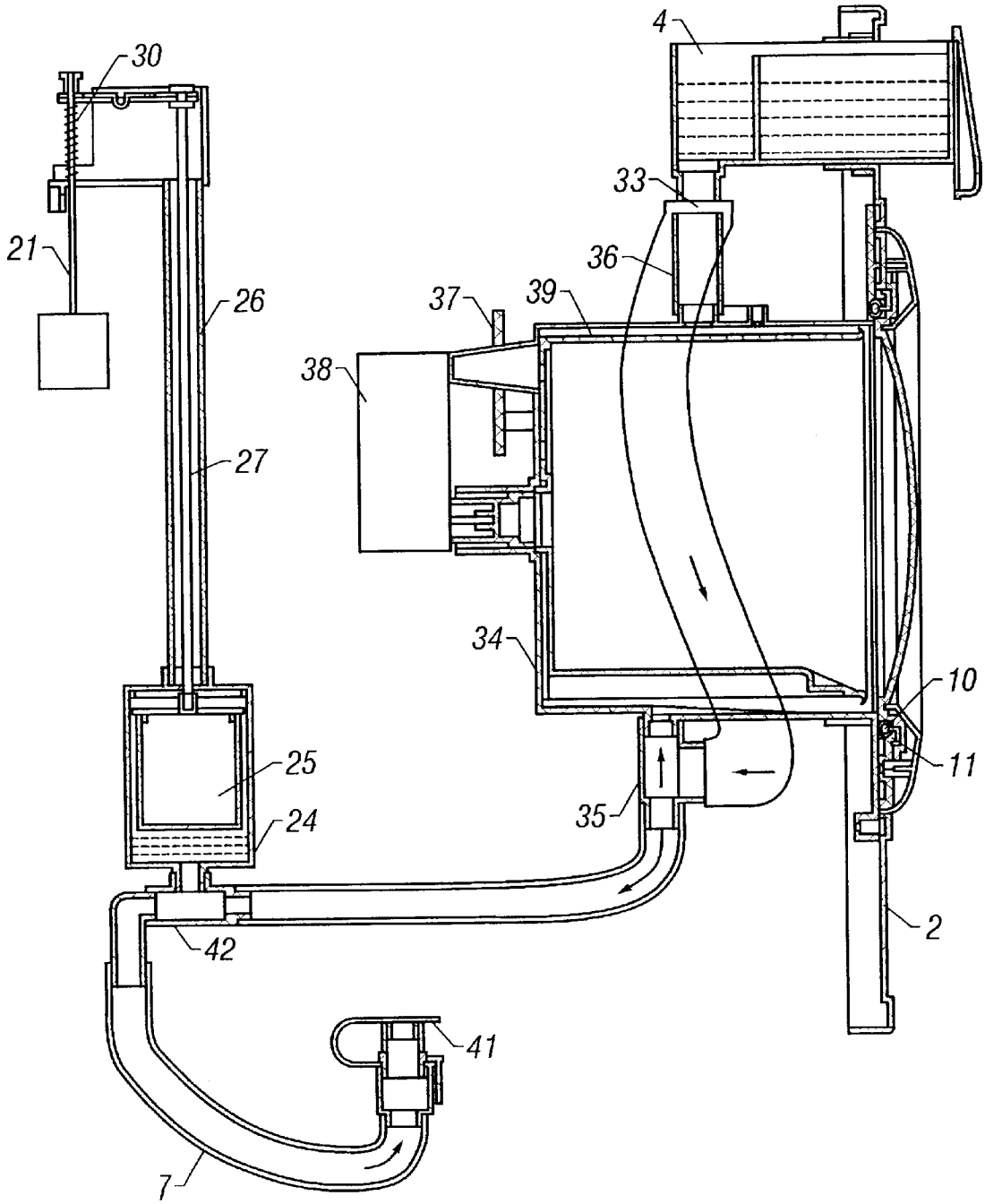
FIG. 8 shows a view of the preferred embodiment.

Before water is let in, the door latch 13 as shown in FIG. 6A must be pushed into the door lock on the front panel 2. As there is still no water, the door can be freely opened and closed. Water is let in through the water inlet drawer 4 as shown in FIG. 8 and passes through the water hose 33 at the bottom of the drawer 4 to the tee pipe 35 of the drum cabin 34. As the position of the floating pontoon cabinet 24 is lower than that of the tee pipe 35 at the bottom of the drum cabin 34, water continues to flow down into the floating pontoon cabinet 24 and not the drum cabin 34. At this time, the safety function of the door lock has not yet been activated, and the door can still be opened. When water continues to flow into the floating pontoon cabinet 24, the floating pontoon 25 rises together with the rubber tube 27 with the rise of the water level, and the lever 29 on its upper part is being activated and presses against the spring 30, allowing the stainless steel pin 21 to fall down due to its own weight. The door latch 13 as shown in FIG. 6A enters into the door lock and holds onto the step of the front panel 2. At the same time, the circular hole on the door lock spring 18 coincides with the hole on the door lock casing 17, allowing the stainless steel pin 21 to descend and pass through the guide hole 23 on the door lock casing 17 and accurately into the door lock spring 18. As shown in FIG. 8, the floating pontoon 25 rises to its highest point with the rise of the water level in the floating pontoon cabinet 24, while the stainless steel pin 21 descends at the same time to its lowest point as shown in FIG. 6B until it is entirely in the door lock casing 17 and the door lock spring 18 and firmly fixed to them. At this moment, with the door lock spring 18 firmly fixed, the door latch 13 can only hold onto the step of the front panel 2 as there is no room for its backward movement. Therefore, the door cannot be opened and the safety function of the door lock is activated.

As water continues to flow in and fill the entire floating pontoon casing 24, and then the drum cabin 34, the water level continues to rise. The accurate positioning of the heterotypic silicon rubber seal 10 enables its hollow round portion to press against the internal door cover 11 and the front panel 2 effecting thereby an air-tight sealing of the drum cabin 34. A ventilation tube 36 on top of the drum cabin 34 ensures the pressure inside the drum cabin 34 is the same as that of the atmosphere and thus enables the water to flow in and out of the drum cabin 34.

As the water level inside the drum cabin 34 rises to two thirds of its height (as specified by product specifications), the water stops increasing. At this moment, as shown in FIG. 1A, the power switch 5 on the upper part of the front panel 2 can be switched on, and the start button 6 on the electronic panel 37 can be pressed down to operate the gear box 38 as shown in FIG. 8 which drives the drum 39 according to a predetermined process to rotate clockwise and then counter-clockwise, giving out at the same time a simulated splashing sound of washing while the four diode tubes 40 shown in FIG. 1A on the front panel 2 continue to flash simulating the flow of water.

Upon completion of the aforesaid processes, the drum 39 stops rotating. The four diode tubes 40 give out a siren while continuing to flash. This is to remind the user that the washing processes have been completed and the water can be drained and the door opened. As the water has not yet been drained, the door lock is still in effect and the door cannot be opened.

The drain hose 7 at the back of the washing machine as shown in FIG. 8 has to be placed on a level surface. When the plug 41 on the upper part of the drain hose 7 is opened, the water in the drum cabin 34 will flow from the drum cabin 34 to the tee pipe 35. It will then flow to the tee pipe 42 at the lower part of the floating pontoon 24 which is at a lower water level position and will pass through the drain hose 7. As the water continues to drain off, the water level inside the drum cabin 34 continues to fall. Because the position of the floating pontoon cabinet 24 is lower than the bottom part of the drum cabin 34, water remains in the floating pontoon cabinet 24 as long as the water in the drum cabin 34 has not been entirely drained off. As a result, the floating pontoon 25 remains in its highest position and the safety function of the door lock remains in effect.

The water in the floating pontoon cabinet 34 begins to drain only when the water in the drum cabin 34 has been entirely drained off. As the water level begins to fall, the floating pontoon 25 together with the rubber tube 27 also descends, resulting in the loss of support at one end of the lever 29. The other end of the lever 29 rises as the result of the force of the spring 30 and moves the stainless steel pin 21 upward and out of the circular hole 22 on the door lock spring 18 inside the door lock casing 17 as shown in FIG. 6A and FIG. 6B. When the water in the floating pontoon cabinet 24, as shown in FIG. 8, has been completely drained off, the floating pontoon 25 also falls to its lowest point. At this point, the stainless steel pin 21 has also moved to its highest point, leaving and withdrawing entirely from the door lock spring 18. Because the door lock spring 18 is no longer fixed by the stainless steel pin 21, the lever device is again activated. When force is applied externally to the handle of the door latch 13, it presses against the door lock spring 18 to overcome the force of the spring 20 at its other end by means of the metal axis 19 which is its supporting point, and leaves the step of the front panel 2 and the door lock. The door can then be opened without difficulty as there is no longer any water in the drum cabin 34. By fully utilizing the special features of water, such as its fluidity and floatage, in design, and by effectively combining the different operational stages of the preferred embodiment, the present invention succeeds in overcoming the defects existing in products of this kind.

Having thus described a preferred embodiment of the present invention, it should be apparent to those skilled in the art that certain advantages of the described method and system have been achieved. It should also be appreciated that various modifications, adaptations, and alternative embodiments thereof may be made within the scope and spirit of the present invention. The invention is further defined by the following claims.

What is claimed is:

1. A toy washing machine having a protective interlock to prevent the release of water during operation comprising:

a housing;

an internal space within the housing for receiving items to be washed, said internal space accessible through an opening in the housing;

a cover covering the opening;

non-electrical locking means for locking the cover to the housing; and a float mechanism operatively connected to the locking means wherein as water enters the toy washing machine during operation the float mechanism rises and causes the locking means to lock the cover.

2. A toy washing machine according to claim 1 wherein the cover comprises a transparent section for viewing the internal space, an outer section surrounding the transparent section and an inner section abutting the housing, said sections connected together.

3. A toy washing machine according to claim 2 further comprising a seal member, said seal member secured to the cover to provide a seal around the opening.

4. A toy washing machine according to claim 3 wherein the seal member has an annular projection, said projection pressed between the transparent section and the inner section of the cover to secure the seal member to the cover.

5. A toy washing machine according to claim 3 wherein the seal member has a hollow interior.

6. A toy washing machine according to claim 3 wherein the seal member is made of heterotypic silicon rubber.

7. A toy washing machine according to claim 2 further comprising two hinges connected to the housing, a third hinge connected to the outer section at one end of the cover and an axle joining the hinges wherein the cover rotates about the hinges relative to the housing.

8. A toy washing machine according to claim 7 wherein the hinges are made of metal.

9. A toy washing machine according to claim 7 further comprising a latch for latching the cover to the housing wherein the latch and the hinges position the cover in relation to the housing.

10. A toy washing machine according to claim 1 wherein the locking means comprises a lock casing with a circular hole, an axle connected to the lock casing, a lever with another circular hole and rotatable about the axle, a pin and a spring connected at one end to the lock casing and connected at the other end to the lever wherein the spring urges the lever to press a latch connected to the cover against the housing and wherein, as the float mechanism rises, the pin is inserted through the circular holes to fix the position of the lever.

11. A toy washing machine according to claim 1 wherein the float mechanism comprises a container for receiving water, a float within the container, a tube connected to the float, a lever with two ends, one end connected to the tube and the other end connected to a pin for locking the cover wherein, as the container receives water, the float rises and moves the tube and the one end of the lever in one direction and the other end of the lever and the pin in an opposite direction to lock the cover.

12. A toy washing machine according to claim 11 wherein a guiding tube connected to the container surrounds the tube.

13. A toy washing machine according to claim 11 wherein the float mechanism is positioned below the internal space.

14. A toy washing machine having a protective interlock to prevent the release of water during operation comprising:

means for housing the toy washing machine;

means for storing items to be washed, said storing means within the housing means and accessible through an opening;

means for covering the opening;

non-electrical means for locking the covering means to the housing means; and means for floating a float, said floating means operatively connected to the locking means, wherein as water enters the toy washing machine during operation the float rises and causes the locking means to lock the cover.

15. A toy washing machine according to claim 14 further comprising a means for sealing around the opening, said sealing means secured to the covering means.

16. A toy washing machine according to claim 14 further comprising means for hinging the covering means to the housing means wherein the covering means rotates about the hinging means relative to the housing means.

17. A toy washing machine according to claim 14 further comprising a means for latching the covering means to the housing means.

18. A toy washing machine according to claim 14 wherein the floating means is positioned below the storage means.

* * * * *

UNITED STATES PATENT AND TRADEMARK OFFICE

CERTIFICATE OF CORRECTION

PATENT NO. : 6,582,276 B1
DATED : June 24, 2003
INVENTOR(S) : Wei Gang Bao

It is certified that error appears in the above-identified patent and that said Letters Patent is hereby corrected as shown below:

Column 4,
Line 8, the word "look" should be corrected to read as -- lock --

Signed and Sealed this

Sixteenth Day of December, 2003

JAMES E. ROGAN
*Director of the United States Patent and Trademark Office*